United States Patent [19]

Quecchia et al.

[11] Patent Number: 4,488,421

[45] Date of Patent: Dec. 18, 1984

[54] MANDREL-CARRIER HEAD FOR A RESTRAINED-MANDREL CONTINUOUS ROLLING MILL

[75] Inventors: Giorgio Quecchia, Corsico; Filippo Cattaneo, Milan, both of Italy

[73] Assignee: Innse Innocenti Santeustacchio S.p.A., Brescia, Italy

[21] Appl. No.: 504,673

[22] Filed: Jun. 15, 1983

[30] Foreign Application Priority Data

Jun. 17, 1982 [IT] Italy ..... 21913 A/82

[51] Int. Cl.[3] ..... B21B 17/10

[52] U.S. Cl. ..... 72/208; 72/96; 72/209

[58] Field of Search ..... 72/208, 209, 96, 97, 72/479

[56] References Cited

U.S. PATENT DOCUMENTS 4,285,226 8/1981 Gancia ..... 72/208

*Primary Examiner*—Lowell A. Larson
*Assistant Examiner*—Jorji M. Griffin
*Attorney, Agent, or Firm*—Hedman, Gibson, Costigan & Hoare

[57] ABSTRACT

A mandrel-carrier head for fixed-mandrel continuous rolling mill has a horizontal hook portion engageable with the tail of the mandrel. This portion has a U-section in the direction of the rolling axis. One of the limbs or a part thereof is movable towards and away from the other limb, so as to lock the tail of the mandrel previously positioned between the limbs.

6 Claims, 3 Drawing Figures

MANDREL-CARRIER HEAD FOR A RESTRAINED-MANDREL CONTINUOUS ROLLING MILL

BACKGROUND OF THE INVENTION

The present invention relates to a continuous rolling mill for producing seamless tubes from round intermediate forgings which are pierced axially and fitted onto respective mandrels, the rolling mill operating by the so-called restrained mandrel process.

In particular, this invention concerns a mandrel-carrier head used in a rolling mill of the aforesaid type for coupling a mandrel to an operating device which, if necessary, pre-inserts and then inserts the mandrel into an axially pierced intermediate forging to be rolled, pushes the mandrel between the rolls of the rolling mill along the rolling axis, retains the mandrel during the rolling of the intermediate forging, and finally recovers the mandrel when the rolling is finished. Such a device may be constituted, for example, by a racked rod which is engaged with one or more driven pinions and has an end portion formed in a suitable manner for firmly supporting a mandrel-carrier head.

In the structure of a mandrel-carrier head formed according to the prior art, there can be indentified basically a first portion for coupling to the rack and a second portion for coupling to an end part or tail of a mandrel. Usually, the second portion of the mandrel-carrier head has an essentially U-section widened in a direction parallel to the rolling axis, in which the limbs have different lengths and give this second portion and the entire mandrel-carrier head substantially a horizontal hook shape. The tail of the mandrel is also formed and shaped so as to engage or, better, hook onto the second portion of the mandrel-carrier head, and this hooking occurs automatically during positioning of the mandrel on the rolling axis upstream of the continuous rolling mill.

For a number of different reasons, such as, for example, thermal expansion of the mandrel, its deformation, unavoidable play and inaccuracies in the devices for transferring the mandrel, the inexact positioning of fixed abutments and/or stop devices, and other similar errors, this positioning is crude, that is to say, it may vary by several centimeters with respect to an ideal predetermined position. Consequently, in order to ensure that the automatic hooking always occurs, the distance between the limbs of the hook portion of the mandrel-carrier head is considerably greater than the length of the tail of the mandrel.

A mandrel-carrier head so constructed, however, has recognised technical disadvantages which have not been overcome until now. Indeed, when hooking has occurred, and the operations of inserting the mandrel into the intermediate forging, retaining the mandrel during the rolling, and recovering the mandrel are carried out, the tail of the mandrel knocks repeatedly and violently against the limbs of the hook portion of the mandrel-carrier head and may damage (for example, deform or even break) the mutually hooked parts.

A further disadvantage is constituted by the fact that the stresses and pressures acting on the mandrel during rolling may have vertical components, more or less accidentally, of such a degree as to cause the vertical movement of the tail of the mandrel with consequent unhooking thereof from the mandrel-carrier head. The serious consequences of such an eventuality are well known to those skilled in the art.

The problem behind this invention is that of devising and providing a mandrel-carrier head having structural and functional characteristics such as to overcome finally the disadvantages described above with reference to the prior art.

SUMMARY OF THE INVENTION

This problem is solved according to the invention by a mandrel-carrier head for a restrained-mandrel continuous rolling mill, comprising an essentially horizontal hook portion engageable with the tail of a mandrel, the portion having a U-section widened in a direction parallel to the rolling axis with limbs of different lengths, characterised in that at least one part of at least one of the limbs is movable on the hook portion towards and away from the other limb, an actuator member being provided for the guided displacement of said at least one movable part of the limb.

In accordance with a second characteristic of the invention, the actuator member is mounted on the mandrel-carrier head itself.

According to a preferred embodiment, the actuator member is constituted by a pusher having a straight line of action perpendicular to the limbs of the hook portion of the mandrel-carrier head.

During the positioning of a mandrel on a rolling line, with the simultaneous hooking of its tail into the mandrel-carrier head, the movable limb of the hook portion is retained in a position furthest from the other limb. Thus, the desired hooking occurs safely even if there are errors in the positioning of the mandrel on the rolling axis.

Once hooking has taken place, the tail of the mandrel is locked between the opposing limbs of the hook portion by operation of the actuator member. When locking has occurred, the rolling cycle may be started, for example, by operation of the racked rod on the end of which is mounted the mandrel-carrier head of the invention.

Further characteristics and advantages will become clearer from the following description of one embodiment of a mandrel-carrier head according to the invention, made with reference to the appended drawings, given by way of non-limiting example, in which:

DESCRIPTION OF A PREFERRED EMBODIMENT

Figure 1:
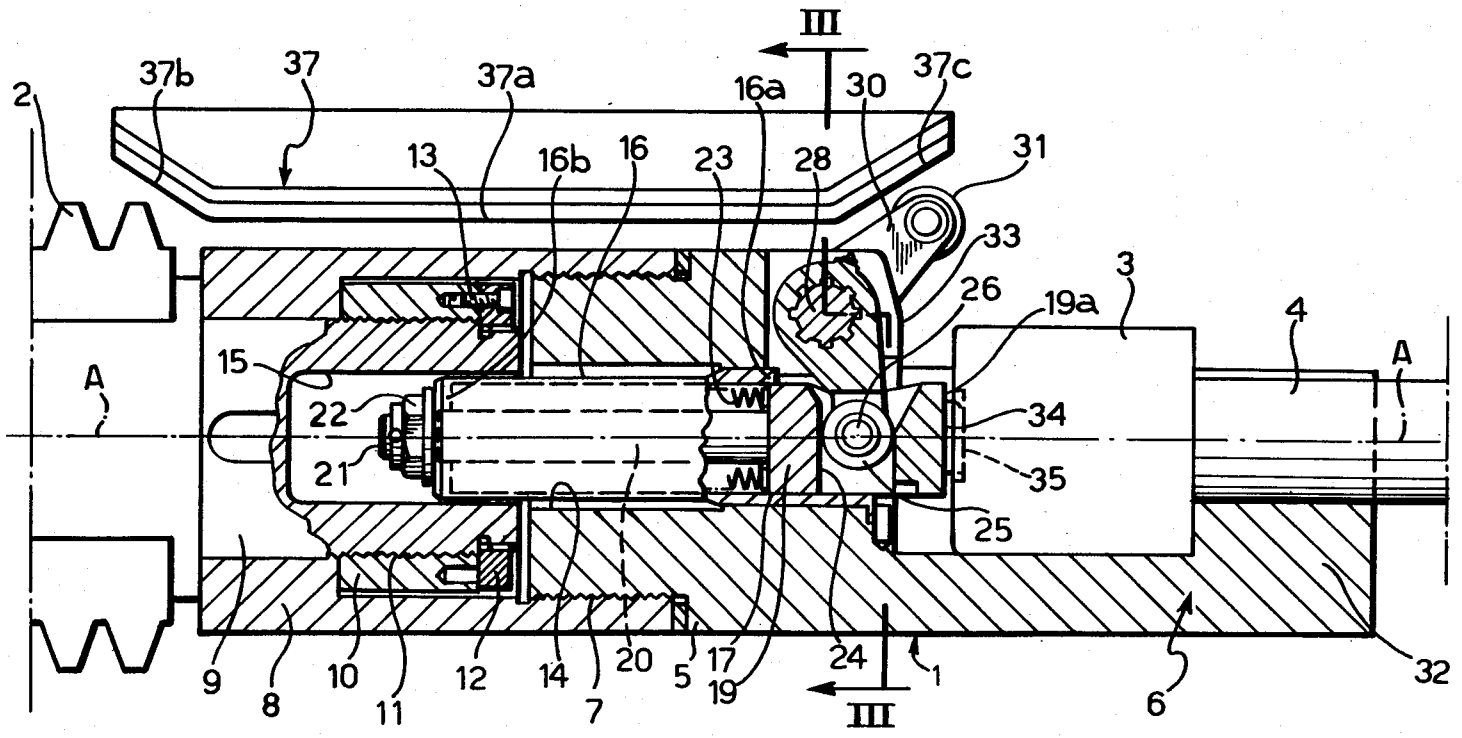
FIG. 1 is a longitudinal section of a mandrel-carrier head according to the invention.

With reference to the drawings, a mandrel-carrier head according to the invention, generally indicated 1, is intended to be coupled, on the one hand, to a racked rod 2 and, on the other hand, to the tail 3 of a mandrel 4 of the type generally used in continuous rolling mills for the production of seamless tubes by the so-called restrained mandrel process.

The racked rod 2 and the mandrel 4 are aligned with a common longitudinal axis A which coincides with the rolling axis.

The mandrel-carrier head 1 includes a rear portion 5 which is essentially cylindrical with its axis horizontal and coinciding with the axis A, and an essentially horizontal, front hook portion 6.

The portion 5 has an external screw-threaded section 7 onto which is screwed a sleeve 8. The sleeve 8, which is fitted onto an end spigot portion 9 of the racked rod 2, is releasably locked in this position by means of a ring 10 screwed, in its turn, onto a threaded section 11 of the spigot. The undesirable unscrewing of the ring 10 is prevented by a ring 12 which is mounted coaxially on an end portion of the spigot 9 and is fixed to the ring 10 by a plurality of screws 13.

The cylindrical portion 5 has a coaxial through-hole 14 aligned with a blind hole 15 formed axially in the spigot portion 9 of the racked rod 2.

A cylindrical housing 16 is located coaxially in the holes 14, 15 and has a frontal mouth portion **16*a* extending at the bottom as a lip 17 by means of which the housing 16 is locked in its predetermined position with the aid of means known per se, not shown. A piston 19 is movable in the housing 16 and is mounted at one end of a shaft 20 to the other end 21 of which projects from the end 16*b* of the housing 16. A nut 22 is screwed adjustably onto the end 21 and is used for pre-loading a pack of Belleville washers 23 mounted on the shaft 20 between the piston 19 and the end 16*b* of the cylindrical housing 16**.

The piston 19 is traversed radially by a square hole 24 in which is guided a roller 25 mounted idly on a pin 26 at the lower end of an arm 27. The other end of the arm 27 is keyed onto a cylindrical pin 28 having a horizontal axis perpendicular to the axis A and rotatably supported in a conventional manner by the portion 5 of the mandrel-carrier head. On a section **28*a* of the pin 28 projecting laterally relative to the portion 5 of the mandrel-carrier head 1 is keyed the lower sleeve-like end 29 of a lever 30 the other end of which supports a wheel 31 for free rotation. The position of the lever on the pin 28 may be varied to form, with the arm 27, a presser member which acts on the piston 19**.

With reference to FIG. 1, when the lever 30 is displaced angularly in a clockwise sense about the axis of the pin 28, the arm 27 exerts a thrust on the piston 19, through the roller 25, in the direction of insertion of the piston in the housing 16, against the action of the pack of washers 23.

The action on the lever 30 being relaxed, the effect of the washers 23 on the piston 19 becomes prevalent whereby it is urged outwardly of the housing, as will be better understood from the description below.

The horizontal front hook portion 6 of the mandrel-carrier head 1 has, in the direction of the axis A, a U-section with limbs of different lengths. More particularly, the front limb 32 is shorter than the rear limb 33 which is constituted by the front wall of the portion 5 of the mandrel-carrier head 1. It should be noted that the mouth **16*a*–17 of the cylindrical housing 16, through which the piston 19 is movable, opens into the rear limb 33. The front wall 19*a* of the piston 19 constitutes essentially a part of the rear limb 33 of the hook portion 6 of the mandrel-carrier head 1**.

The distance between the limbs 32, 33 of this hook portion 6 is always greater than the length of the tail 3 of the mandrel 4, when the piston 19 is fully inserted in the housing 16.

It should also be noted that a tooth 34 is formed with or otherwise fixed to the front wall **19*a* of the piston 19 and is intended to engage a recess 35 formed in the rear wall of the mandrel 3**.

The operation of the mandrel-carrier head 1 of the invention is as follows.

Figure 2:
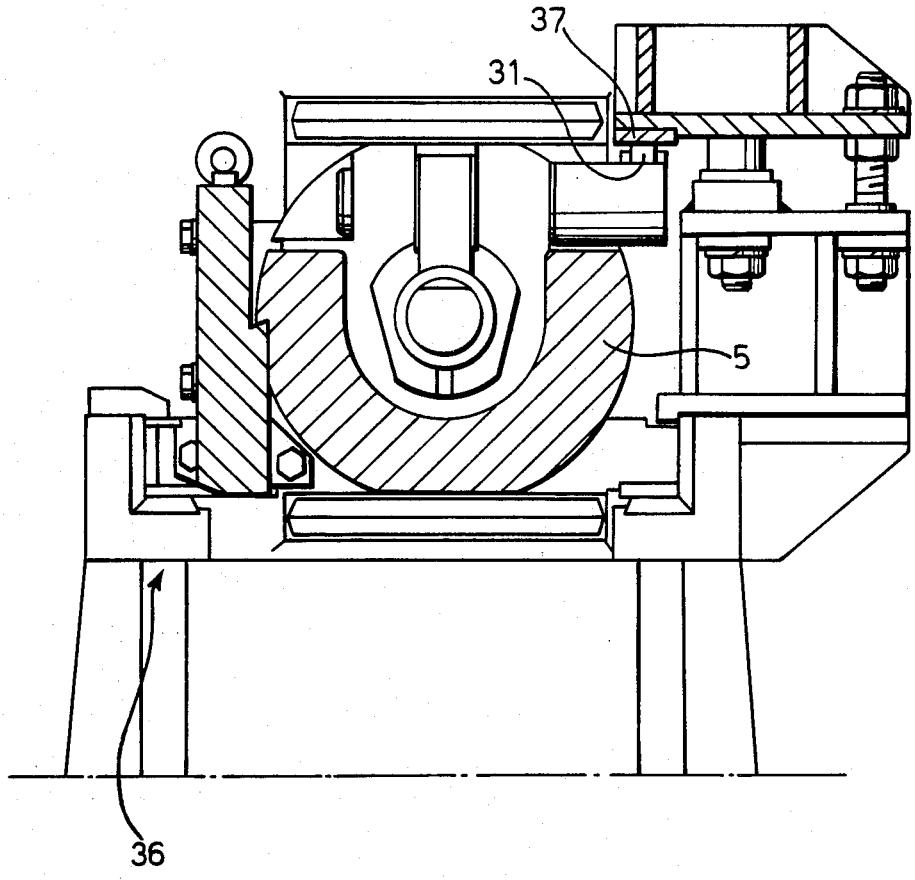
FIG. 2 is a cross-section taken on the line II—II of FIG. 1.
Figure 3:
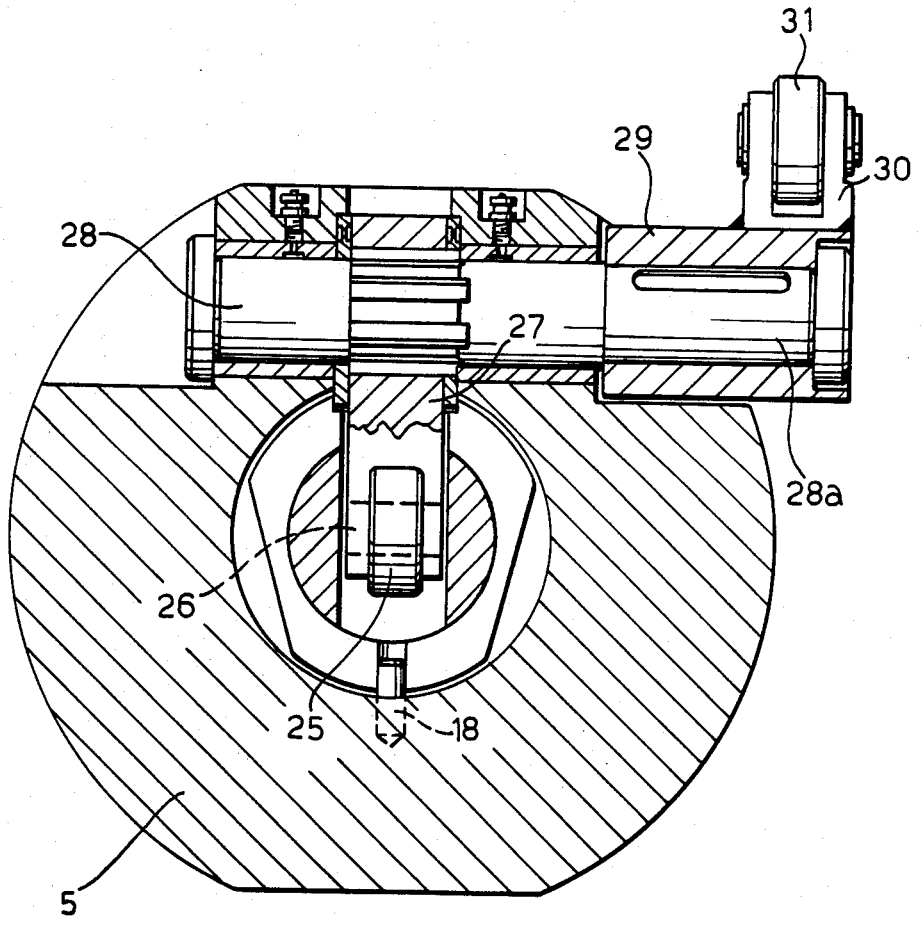
FIG. 3 is a cross-section taken on the line III—III of FIG. 1.

Initially, the mandrel-carrier head 1 is brought, by the action of the racked rod 2, into a predetermined position on the rolling line to couple with a mandrel 4. In this position, a cam 37 with a straight, horizontal central section **37*a* and upwardly inclined end sections 37*b*, 37*c* is fixed to the bench or other supporting structure, schematically indicated 36 in FIG. 2, normally used to support both the racked rod 2 and the mandrel 4. When, during the positioning of the mandrel-carrier head 1 in correspondence with the cam, the wheel 31 is engaged by the central section 37*a* of the cam, the lever 30 is displaced angularly in a clockwise sense (with reference to FIG. 1) about the axis of the pin 28, and the lever 27 and its idle roller 25 undergo an equal angular displacement. Consequently, the piston 19 is withdrawn into the housing 16 against the action of the Belleville washers 23. In this condition, the wall 19*a* of the piston 19 is coplanar with, or projects only a small distance from, the rear limb 33 of the hook portion 6 of the mandrel-carrier head 1**.

In this condition, the mandrel-carrier head is ready to couple the tail 3 of a mandrel 4 with the hook portion 6.

When the hooking has been effected, the mandrel-carrier head 1 is advanced towards the rolling mill and, from the beginning of this displacement, the wheel 31 leaves contact with the cam 37. Consequently, the effect of the Belleville washers 23 again prevails on the piston 19. The piston, thrust by the washers 23, pushes the tail 3 of the mandrel 4 against the front limb 32 of the hook portion 6, achieving the desired locking of the mandrel. It should be noted that, when the piston 19 comes into contact with the tail 3 of the mandrel, the tooth 34 of the piston is engaged automatically with its seat 35 in the mandrel, an engagement which prevents the mandrel from unlocking from the mandrel-carrier head 1 during rolling.

Once rolling has finished, the mandrel 4 is recovered from the continuous rolling mill and the mandrel-carrier head 1 is returned to its initial position. In this position, the wheel 31 is again engaged by the central section **37*a* of the cam 37 and the piston 19 is again withdrawn into the housing 16 against the action of the Belleville washers 23. Consequently, the tail 3 of the mandrel is freed from engagement with the tooth 34 and is spaced from the piston 19**, so that the entire mandrel may be lifted away from the mandrel-carrier head.

We claim:

1. A mandrel-carrier head for a restrained-mandrel continuous rolling mill, comprising an essentially horizontal hook portion engageable with the tail of said mandrel and having a U-section which is widened in a direction parallel to the rolling axis of the mill and has limbs of different lengths, wherein at least one part of at least one of said limbs is movable on the hook portion towards and away from the other said limb, and an actuator member is provided for the guided displacement of said at least one movable part of said at least one limb.

2. A mandrel-carrier head as defined in claim 1, wherein said actuator member is mounted on the mandrel-carrier head.

3. A mandrel-carrier head as defined in claim 2, wherein said actuator member is constituted by a pusher having a straight line of action perpendicular to the limbs of said hook portion.

4. A mandrel-carrier head as defined in claim 3, wherein said pusher comprises a cylindrical housing, a shaft movable axially in the cylindrical housing, a piston head fixed to an end of the shaft, resiliently deformable members located in the housing between the piston and the end of the housing, and presser members for returning the piston into the housing against the action of the resiliently deformable members.

5. A mandrel-carrier head as defined in claim 1, wherein said at least one part of said at least one limb of said hook portion has a fixed tooth and the rear end of the tail of said mandrel has a recess in which said tooth is engageable.

6. A mandrel-carrier head as defined in claim 4 or claim 5, wherein said at least one movable part of said at least one limb of said hook portion is constituted by the front wall of said piston.

* * * * *